US008820544B2

(12) United States Patent
Lindgren et al.

(10) Patent No.: US 8,820,544 B2
(45) Date of Patent: Sep. 2, 2014

(54) ADJUSTABLE DISHWASHER RACK

(75) Inventors: Gary M. Lindgren, Three Oaks, MI (US); David A. Stevens, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1253 days.

(21) Appl. No.: 12/266,914

(22) Filed: Nov. 7, 2008

(65) Prior Publication Data

US 2010/0116759 A1 May 13, 2010

(51) Int. Cl.
*A47G 19/08* (2006.01)

(52) U.S. Cl.
USPC ..... 211/41.8

(58) Field of Classification Search
USPC ..... 211/41.4–41.9, 70.7, 85.25, 85.31, 211/133.2, 133.5, 126.9, 181.1, 184; 220/487, 488
See application file for complete search history.

(56) References Cited

U.S. PATENT DOCUMENTS

| | | | | |
|---|---|---|---|---|
| 372,123 | A | 10/1887 | Cox | |
| 1,380,534 | A * | 6/1921 | Dalton | 211/49.1 |
| 2,804,213 | A | 8/1957 | Fox et al. | |
| 2,971,668 | A * | 2/1961 | Peglow | 220/488 |
| 3,451,556 | A | 6/1969 | Macoicz | |
| 4,046,261 | A | 9/1977 | Yake | |
| 4,331,243 | A * | 5/1982 | Doll | 211/59.2 |
| 4,606,464 | A * | 8/1986 | Jordan et al. | 211/41.8 |
| 4,917,248 | A * | 4/1990 | Friskney | 211/41.8 |
| 4,927,033 | A * | 5/1990 | Patera et al. | 211/41.9 |
| 4,974,806 | A | 12/1990 | Matern | |
| 5,158,185 | A * | 10/1992 | Michael et al. | 211/41.8 |
| 5,205,419 | A | 4/1993 | Purtilo | |
| 5,351,837 | A * | 10/1994 | Smith | 211/41.8 |
| 5,405,018 | A | 4/1995 | Anthrop, Jr. | |
| 6,364,131 | B1 * | 4/2002 | Moylan | 211/41.9 |
| 6,394,285 | B1 * | 5/2002 | Arthurs et al. | 211/41.9 |
| 6,460,710 | B1 * | 10/2002 | Dardashti | 211/184 |
| 6,827,225 | B2 | 12/2004 | Miilu et al. | |
| 2005/0236345 | A1 * | 10/2005 | Herbst et al. | 211/41.9 |
| 2005/0241686 | A1 * | 11/2005 | Woo | 134/135 |
| 2006/0113262 | A1 * | 6/2006 | Knorring et al. | 211/59.2 |
| 2006/0138064 | A1 * | 6/2006 | Crudgington, Jr. | 211/41.9 |
| 2006/0157430 | A1 * | 7/2006 | Disch et al. | 211/41.3 |
| 2007/0247039 | A1 * | 10/2007 | Anderson et al. | 312/228.1 |

FOREIGN PATENT DOCUMENTS

| | | | |
|---|---|---|---|
| DE | 3130627 | A1 | 2/1983 |

* cited by examiner

*Primary Examiner* — Jonathan Liu
*Assistant Examiner* — Patrick Hawn

(57) ABSTRACT

A dishwasher includes an adjustable dishwasher rack that accommodates certain types of dishes (e.g., bowls) of varying sizes and shapes. The dishwasher rack includes a pair of parallel guide rails. A plurality of retainer assemblies ride along the guide rails. Each of the retainer assemblies has (i) a first clip positioned on the first guide rail, (ii) a second clip positioned on the second guide rail, and (iii) a retaining wire having a first end that is secured to the first clip and a second end that is secured to the second clip.

17 Claims, 4 Drawing Sheets

ADJUSTABLE DISHWASHER RACK

TECHNICAL FIELD

The present disclosure relates generally to a dishwasher and more particularly to an adjustable dish rack for a dishwasher.

BACKGROUND

A dishwasher is a domestic appliance into which dishes and other cooking and eating wares (e.g., plates, bowls, glasses, flatware, pots, pans, bowls, etcetera) are placed to be washed. A dishwasher includes a number of dishwasher racks which support such wares.

SUMMARY

According to one aspect, a dishwasher includes a tub defining a washing chamber and a rack positioned in the chamber. The rack has a first guide rail and a second guide rail that is parallel to the first guide rail. A first clip is positioned on the first guide rail. The first clip is positionable between (i) a locked position in which the first clip is prevented from sliding along the first guide rail, and (ii) an unlocked position in which the first clip is permitted to slide along the first guide rail. A second clip is positioned on the second guide rail. A retaining wire has a first end that is secured to the first clip and a second end that is secured to the second clip.

Movement of the first clip along the first guide rail causes corresponding movement of the second clip along the second guide rail.

The rack may also include a frame having a number of wire tines secured thereto to define dish supports. The first guide rail and the second guide rail may be positioned in the frame.

A roller assembly may be positioned in the dishwasher between the tub and the rack. The roller assembly includes a number of rollers that roll along a roller-support rail. Movement of the number of rollers along the rail allows a front edge of the rack to move into and out of the tub. The guide rails of the rack may be positioned generally parallel to the roller-support rail of the roller assembly.

The first clip of the rack may include a pair of finger handles, each of which has a first end which engages the first guide rail and a second end extending upwardly from the first guide rail. When the second ends of the finger handles are urged toward one another, the first ends of the finger handles are urged away from one another thereby positioning the first clip in the unlocked position in which the first clip is permitted to slide along the first guide rail.

The first guide rail may include a guide wire. The first clip may have a slot into which the guide wire is received.

According to another aspect, a dishwasher rack includes a frame having a number of wire tines secured thereto to define dish supports. The dishwasher rack also includes a first guide rail secured to the frame and a second guide rail secured to the frame. The second guide rail is arranged in an orientation that is parallel to the first guide rail. A first clip may be positioned on the first guide rail. The first clip may be positionable between (i) a locked position in which the first clip is prevented from sliding along the first guide rail, and (ii) an unlocked position in which the first clip is permitted to slide along the first guide rail. A second clip is positioned on the second guide rail. A retaining wire has a first end that is secured to the first clip and a second end that is secured to the second clip.

Movement of the first clip along the first guide rail causes corresponding movement of the second clip along the second guide rail.

The first clip may include a pair of finger handles, each of which has a first end that engages the first guide rail and a second end extending upwardly from the first guide rail. When the second ends of the finger handles are urged toward one another the first ends of the finger handles are urged away from one another thereby positioning the first clip in the unlocked position in which the first clip is permitted to slide along the first guide rail.

The first guide rail may include a guide wire. The first clip may include a slot into which the guide wire is received.

According to another aspect, a dishwasher rack includes a frame having a number of wire tines secured thereto to define dish supports. A first guide rail is secured to the frame. A second guide rail is also secured to the frame and arranged in an orientation that is parallel to the first guide rail. The rack also includes a plurality of retainer assemblies, each of which has (i) a first clip positioned on the first guide rail, (ii) a second clip positioned on the second guide rail, and (iii) a retaining wire having a first end that is secured to the first clip and a second end that is secured to the second clip.

The first clip of each of the plurality of retainer assemblies is positionable between (i) a locked position in which the first clip is prevented from sliding along the first guide rail, and (ii) an unlocked position in which the first clip is permitted to slide along the first guide rail.

The first clip of each of the plurality of retainer assemblies includes a pair of finger handles, each of which has a first end which engages the first guide rail and a second end extending upwardly from the first guide rail. When the second ends of the finger handles are urged toward one another, the first ends of the finger handles are urged away from one another and out of contact with the first guide rail.

The first guide rail includes a guide wire. The first clip of each of the plurality of retainer assemblies includes a slot into which the guide wire is received.

BRIEF DESCRIPTION OF THE DRAWINGS

The detailed description particularly refers to the following figures, in which.

DETAILED DESCRIPTION OF THE DRAWINGS

Figure 1:
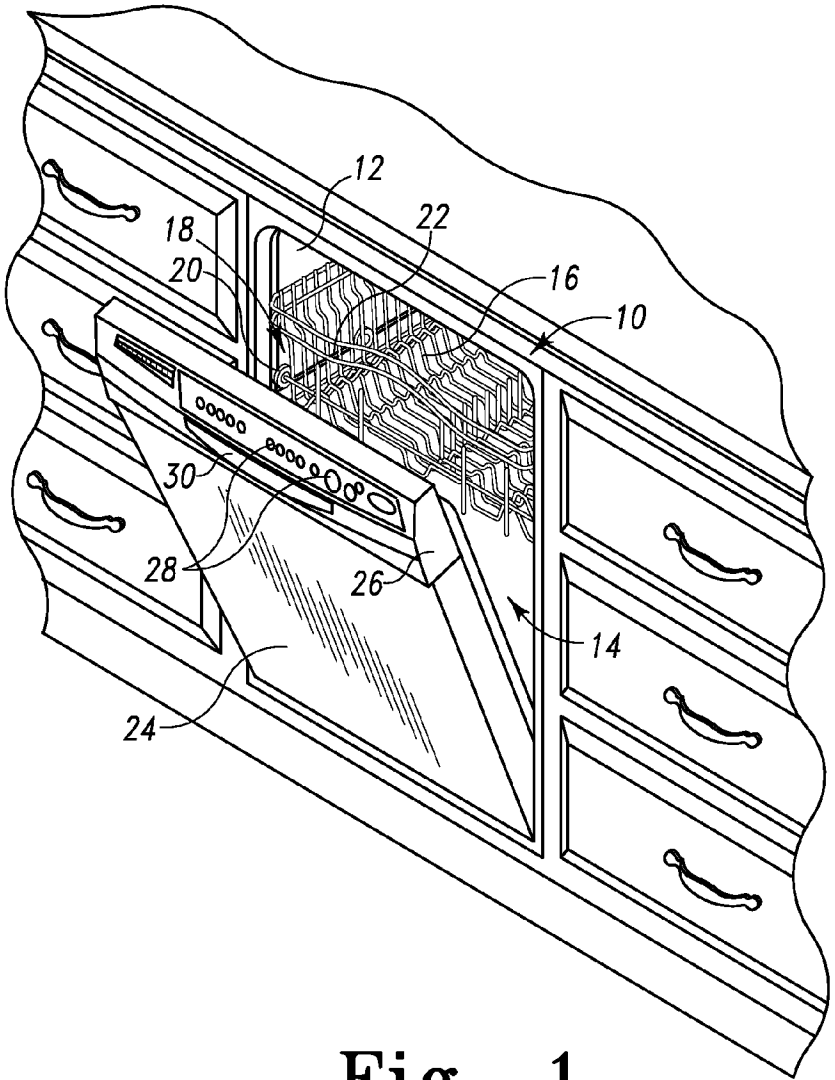
FIG. 1 is fragmentary perspective view of a dishwasher installed in a kitchen cabinet.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, there is shown a dishwasher 10 having a tub 12 which defines a washing chamber 14 into which dishes and other cooking and eating wares (e.g., plates, bowls, glasses, flatware, pots, pans, bowls, etcetera) are placed to be washed. The dishwasher 10 includes a number of racks 16 located in the tub 12. An upper dishwasher rack 16 is shown in FIG. 1, although a lower dishwasher rack is also included in the dishwasher 10. A number of roller assemblies 18 are positioned between the dishwasher rack 16 and the tub 12. The roller assemblies 18 allow the dishwasher racks 16 to extend from, and retract back into, the tub 12. Such movement facilitates the loading and unloading of the dishwasher racks 16. The roller assemblies 18 include a number of rollers 20 which roll along the top of, and in some cases the top and bottom of, a corresponding support rail 22.

A door 24 is hinged to the lower front edge of the tub 12. The door 24 permits access to the tub 12 to load and unload the dishwasher 10. The door 24 also seals the front of the dishwasher 10 during a wash cycle. A control panel 26 is located at the top of the door 24. The control panel 26 includes a number of controls 28, such as buttons and knobs, that are used to control operation of the dishwasher 10. A handle 30 is also included in the control panel 26. The handle 30 is operable by a user to unlatch the door 24 so that it may be opened by a user.

Figure 2:
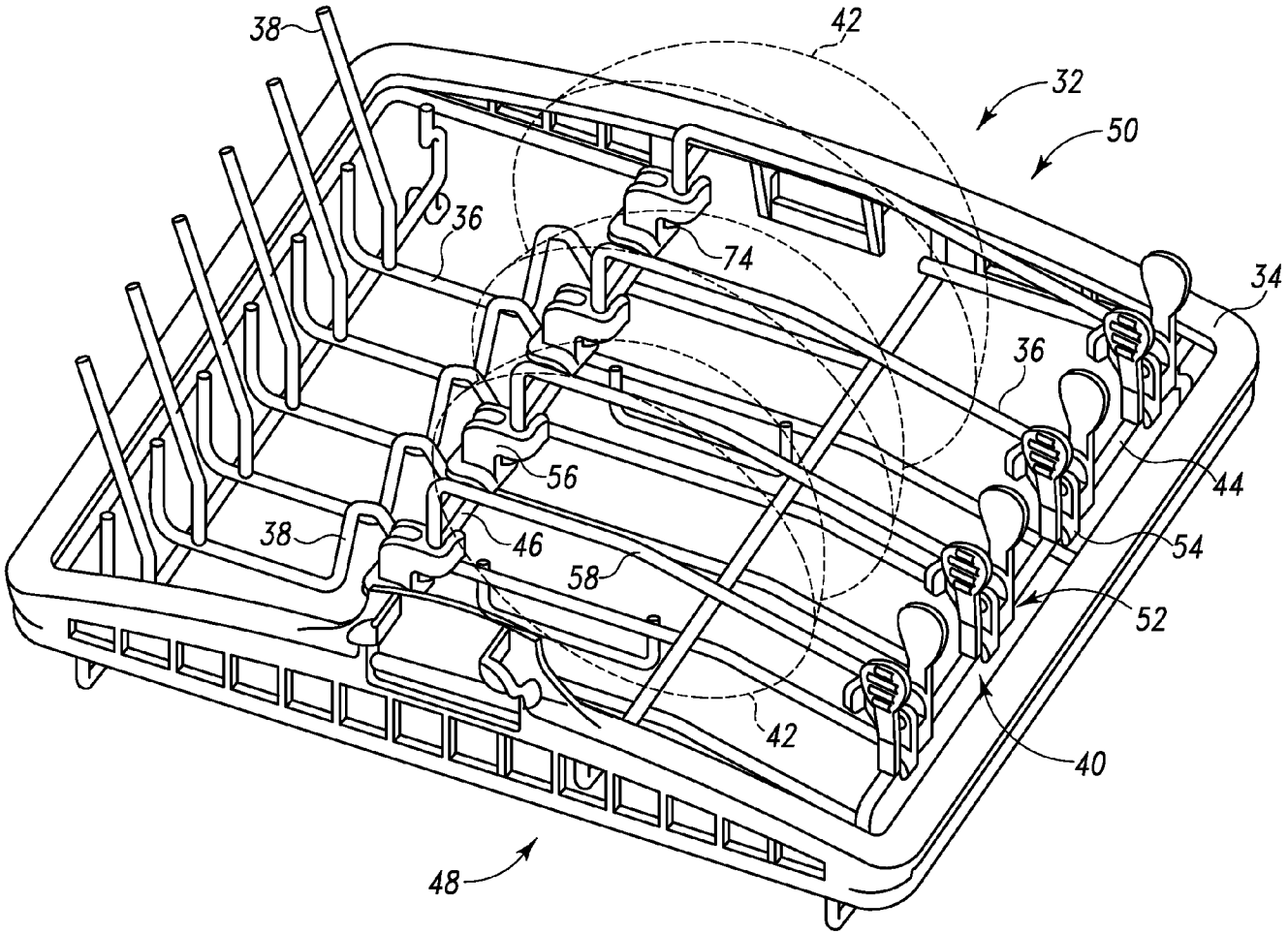
FIG. 2 is a perspective view of a dishwasher rack that may be used in the dishwasher.

Referring now to FIG. 2, there is shown a dishwasher rack 32 that may be used as either the upper or lower dishwasher rack 16. The dishwasher rack 32 includes a frame 34 having a number of lower support wires 36 which define the lower surface of the somewhat basket shape of the dishwasher rack 32. A number of upwardly extending wire tines 38 define dish supports that support dishes or other cooking or eating wares to be cleaned. The configuration of the dish supports formed by the tines 38 in FIG. 2 is illustrative in nature, with many other configurations being contemplated for use as the dish supports of the dishwasher rack 32.

The dishwasher rack 32 also has an adjustable bowl support assembly 40 for positioning and supporting a number of bowls 42 (shown in phantom) of various shapes and sizes. The bowl support assembly 40 includes a pair of parallel guide rails 44, 46 which extend in the general front-to-back direction of the dishwasher rack 32 (i.e., in the direction which extends from the front 48 of the rack 32 to its rear 50). In such a way, the guide rails 44, 46 are arranged generally parallel to the rails 22 of the dishwasher's roller assemblies 18 and hence extend in the front-to-back direction of dishwasher 10.

As shown in FIG. 2, a plurality of retainer assemblies 52 ride along the guide rails 44, 46. Each of the retainer assemblies 52 includes a pair of clips 54, 56 that have a retaining wire 58 extending between them. The clip 54 is the "operable" clip of the retainer assembly 52 in that it is operated by a user to adjust the position of the retainer assembly 52. The clip 56, on the other hand, is a "follower" in that it moves in response to movement of the clip 54. Movement of the clip 54 by the user (i.e., sliding it one direction or the other along the guide rail 44) causes corresponding movement of the clip 56 and hence the retaining wire 58 thereby changing the position of a given retainer assembly 52 relative to an adjacent retainer assembly 52. By changing the distance between adjacent retainer assemblies 52 in such a way, bowls of different sizes and shapes can be accommodated by the dishwasher rack 32.

Figure 3:
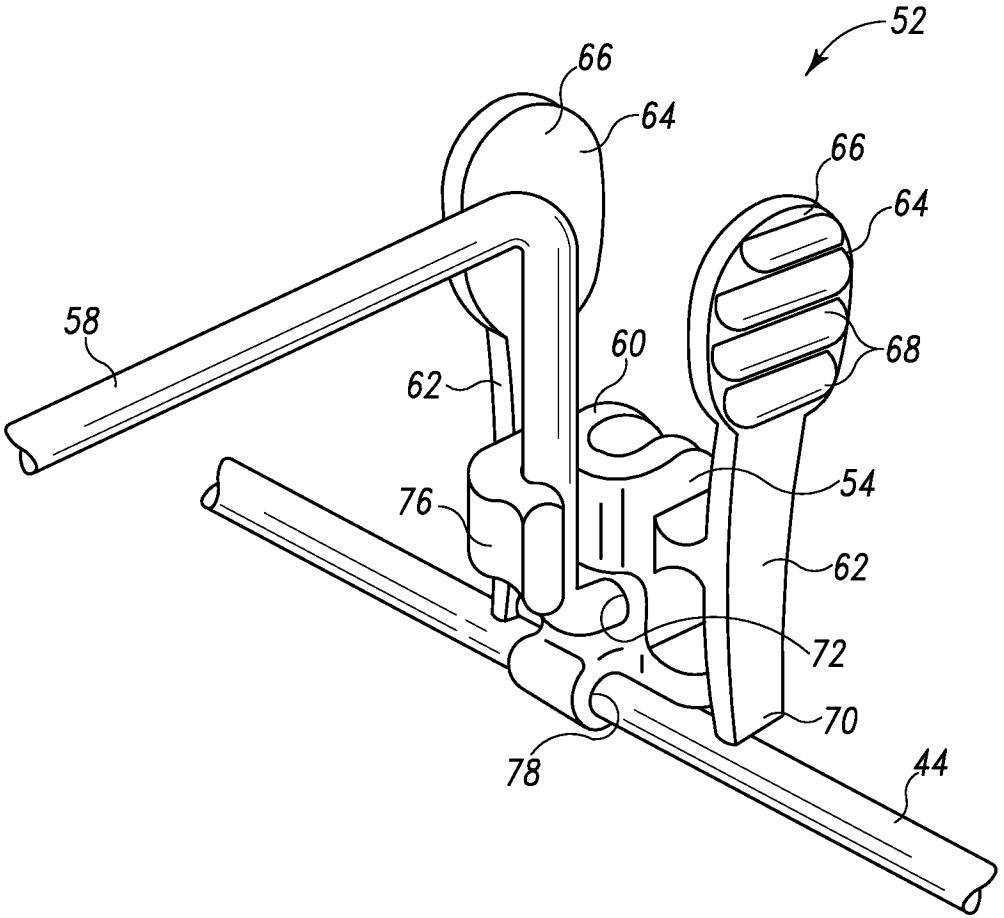
FIG. 3 is a fragmentary perspective view of one of the clips of the dishwasher rack.
Figure 5:
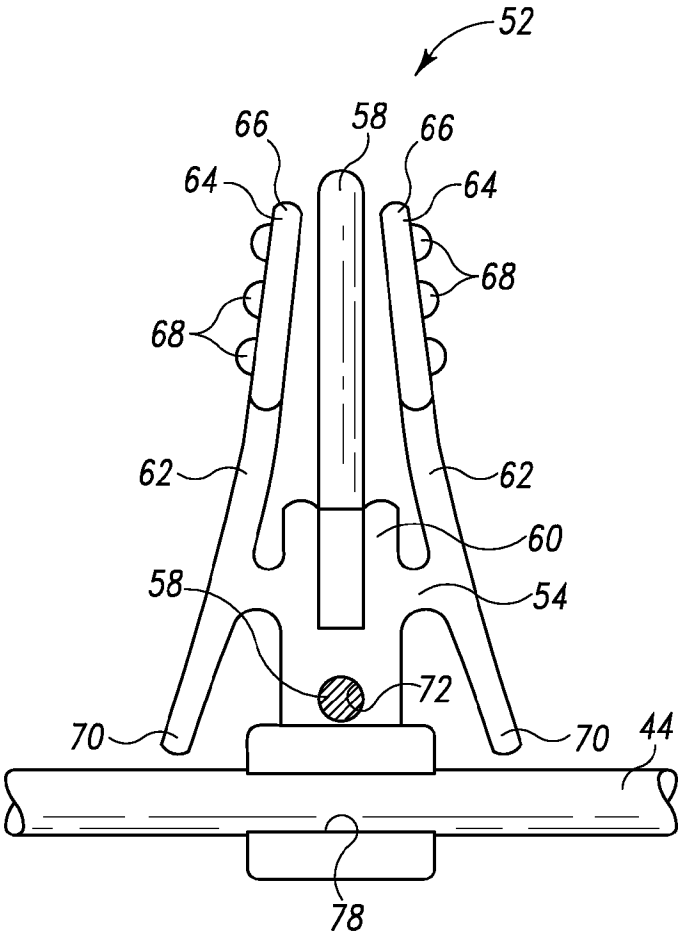
FIG. 5 is view similar to FIG. 4, but showing the clip positioned in its unlocked position.
Figure 4:
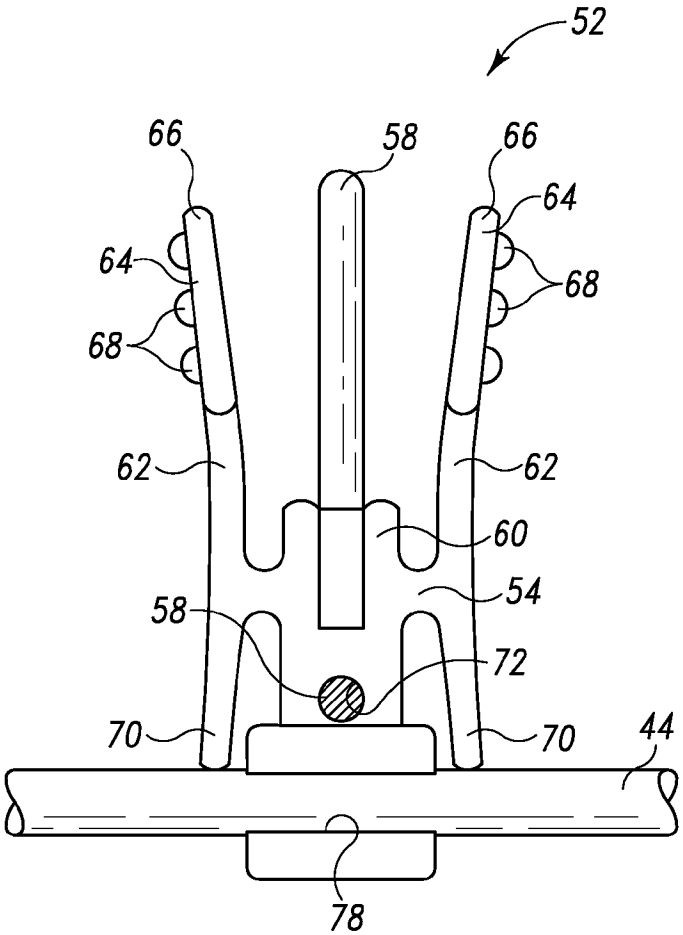
FIG. 4 is an elevation view showing the clip of FIG. 3 positioned in its locked position.

As shown in FIGS. 3-5, each of the clips 54 includes a body 60 having a pair of resilient finger handles 62 extending outwardly therefrom. An upper end 64 of the finger handles 62 includes a grip pad 66 having a gripping feature 68 defined therein. The opposite lower end 70 of the finger handles 62 selectively engages and disengages the guide rail 44.

The body 60 of the clip 54 also includes a hole 72 into which an end of the retaining wire 58 is positioned, with the other end of the retaining wire 58 being received into a hole 74 defined in the follower clip 56 (see FIG. 1). A locking arm 76 (see FIG. 3) supports the retaining wire 58.

A slot 78 is formed in the bottom of the body 60 of the clip 54 (see FIGS. 3-5). In the illustrative embodiment described herein, the guide rail 44 is embodied as a wire that is similar in diameter to the lower support wires 36 of the dishwasher rack 32. Such a guide wire 44 is received into the slot 78. The slot 78 is shown in FIGS. 4 and 5 as being open on one side to allow the clip 54 to be snapped onto the guide rail 44; however, the slot 78 could be embodied as a closed slot into which an end of the guide rail 44 is advanced during assembly of the rack 32.

As demonstrated in FIG. 4, the bias of the finger handles 62 urges its lower ends 70 into engagement with the guide rail 44. When positioned in such a locked position in which the lower ends 70 of the finger handles 62 engage the guide rail 44, the clip 54 (and hence the corresponding clip 56 connected to it via one of the retaining wires 58) is prevented from sliding along the guide rail 44. However, when a user squeezes the grip pads 66 of the clip 54 toward one another (as shown in FIG. 5), the lower ends 70 of the finger handles 62 are urged away from one another and out of contact with the guide rail 44. When positioned in such an unlocked position, the clip 54 is free to be slid in one direction or the other along the guide rail 44. This causes corresponding movement of the clip 56 along the guide rail 46 (i.e., movement of the same distance in the same direction) and hence the retaining wire 58 connecting the two clips 54, 56 thereby changing the position of the retainer assembly 52 relative to an adjacent retainer assembly 52. By changing the distance between the two adjacent retainer assemblies 52 in such a way, bowls of different sizes and shapes can be accommodated by the dishwasher rack 32.

Once positioned in the desired position along the guide rail 44, the user may return the clip 54 to its locked position by simply letting go of the finger handles 62. By doing so, the bias of the finger handles 62 urges the lower ends 70 of the handles 62 toward one another (and hence the grip pads 66 away from one another) thereby returning the clip 54 to its locked position in which the lower ends 70 of the handles 62 engage the guide rail 44 (as shown in FIG. 4). When positioned in its locked position, the clip 54 is prevented from sliding along the guide rail 44. In other words, it is locked in place.

In the illustrative embodiment of FIG. 2, the dishwasher rack 32 includes four retainer assemblies 52 (i.e., it has four sets of clips 54, 56). However, it should be appreciated that the dishwasher rack 32 may be embodied with any number of retainer assemblies 52 (i.e., with any number of sets of clips 54, 56) to fit the needs of a given design.

It should also be appreciated that the dishwasher rack 32 may be embodied as one of the non-removable dishwasher racks within the dishwasher 10. In such a way, a component of the roller assemblies 18 (e.g., the rollers 20 or the rails 22) may be secured to the frame 34 of the dishwasher rack 32. Alternatively, the dishwasher rack 32 may be embodied as a removable module that may be selectively installed and uninstalled from the dishwasher 10. For example, the dishwasher 10 may be embodied with a non-removable dishwasher rack or frame that accepts numerous different removable modules, including the dishwasher rack 32.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the apparatus, system, and method described herein. It will be noted that alternative embodiments of the apparatus, system, and method of the present disclosure may not include all of the features described yet still benefit from at least some of the advantages of such features. Those of ordinary skill in the art may readily devise their own implementations of the apparatus, system, and method that incorporate one or more of the features of the present invention and fall within the spirit and scope of the present disclosure as defined by the appended claims.

The invention claimed is:

1. A dishwasher, comprising:

a tub defining a washing chamber, and a rack positioned in the chamber, the rack having:

a first guide rail, a second guide rail that is parallel to the first guide rail, a first clip mounted on the first guide rail, the first clip being positionable between (i) a locked position in which the first clip is prevented from sliding along the first guide rail, and (ii) an unlocked position in which the first clip is permitted to slide, while mounted, along the first guide rail, a second clip positioned on the second guide rail, and a retaining wire having a first end that is secured to the first clip and a second end that is secured to the second clip.

2. The dishwasher of claim 1, wherein: the rack further comprises a frame having a number of wire tines secured thereto to define dish supports, and the first guide rail and the second guide rail are positioned in the frame.

3. The dishwasher of claim 1, wherein the second clip includes only an unlocked position such that movement of the first clip along the first guide rail causes corresponding movement of the second clip along the second guide rail.

4. The dishwasher of claim 1, further comprising a roller assembly positioned between the tub and the rack, wherein:

the roller assembly comprises a number of rollers that roll along a roller-support rail, movement of the number of rollers along the roller-support rail allows a front edge of the rack to move into and out of the tub, and the first guide rail and the second guide, rail are positioned generally parallel to the roller-support rail.

5. The dishwasher of claim 1, wherein:

the first clip comprises a pair of finger handles each of which has a first end that engages the first guide rail and a second end extending upwardly from the first guide rail, when the second ends of the finger handles are urged toward one another, the first ends of the finger handles are urged away from one another thereby positioning the first clip in the unlocked position in which the first clip is permitted to slide along the first guide rail.

6. The dishwasher of claim 1, wherein:

the first guide rail comprises a guide wire, and the first clip comprises a slot into which the guide wire is received.

7. A dishwasher rack, comprising:

a frame having a number of wire tines secured thereto to define dish supports, a first guide rail secured to the frame, a second guide rail secured to the frame and arranged in an orientation that is parallel to the first guide rail, a first clip mounted on the first guide rail, the first clip being positionable between (i) a locked position in which the first clip is prevented from sliding along the first guide rail, and (ii) an unlocked position in which the first clip is permitted to slide, while mounted, along the first guide rail, along the first guide rail, a second clip positioned on the second guide rail, and a retaining wire having a first end that is secured to the first clip and a second end that is secured to the second clip.

8. The dishwasher rack of claim 7, wherein the second clip includes only an unlocked position such that movement of the first clip along the first guide rail causes corresponding movement of the second clip along the second guide rail.

9. The dishwasher rack of claim 7, wherein:

the first clip comprises a pair of finger handles each of which has a first end that engages the first guide rail and a second end extending upwardly from the first guide rail, and when the second ends of the finger handles are urged toward one another the first ends of the finger handles are urged away from one another thereby positioning the first clip in the unlocked position in which the first clip is permitted to slide along the first guide rail.

10. The dishwasher rack of claim 7, wherein:

the first guide rail comprises a guide wire, and the first clip comprises a slot into which the guide wire is received.

11. A dishwasher rack, comprising:

a frame having a number of wire tines secured thereto to define dish supports, a first guide rail secured to the frame, a second guide rail secured to the frame and arranged in an orientation that is parallel to the first guide rail, and a plurality of retainer assemblies, each of which has (i) a first clip positioned on the first guide rail, (ii) a second clip mounted on the second guide rail, and (iii) a retaining wire, defining a dishware support, having a first end that is secured to the first clip and a second end that is secured to the second clip, wherein the first clip of each of the plurality of retainer assemblies is positionable between (i) a locked position in which the first clip is prevented from sliding along the first guide rail, and (ii) an unlocked position in which the first clip is permitted to slide, while mounted, along the first guide rail such that the plurality of retainer assemblies can be selectively spaced from one another to provide custom spaced dishware supports.

12. The dishwasher rack of claim 11, wherein:

the first clip of each of the plurality of retainer assemblies comprises a pair of finger handles each of which has a first end that engages the first guide rail and a second end extending upwardly from the first guide rail, and when the second ends of the finger handles are urged toward one another the first ends of the finger handles are urged away from one another and out of contact with the first guide rail.

13. The dishwasher rack of claim 11, wherein:

the first guide rail comprises a guide wire, and the first clip of each of the plurality of retainer assemblies comprises a slot into which the guide wire is received.

14. The dishwasher of claim 1, wherein the first clip comprises a body including a slot formed therein for mounting the first clip to the first guide rail, and first and second resilient finger handles extending therefrom, each of the first and second resilient finger handles including a lower end adapted to selectively engage the first guide rail in the locked position and disengage the first guide rail in the unlocked position.

15. The dishwasher of claim 14, wherein, in the locked position, the lower end of each of the first and second resilient finger handles are urged downward against a top of the first guide rail to frictionally lock the first clip in position on the first guide rail.

16. The dishwasher of claim 7, wherein the first clip comprises a body including a slot formed therein for mounting the first clip to the first guide rail, and first and second resilient finger handles extending therefrom, each of the first and second resilient finger handles including a lower end adapted to selectively engage the first guide rail in the locked position and disengage the first guide rail in the unlocked position.

17. The dishwasher of claim 16, wherein, in the locked position, the lower end of each of the first and second resilient finger handles are urged downward against a top of the first guide rail to frictionally lock the first clip in position on the first guide rail.

* * * * *